US007017251B1

(12) United States Patent
Murphy

(10) Patent No.: US 7,017,251 B1
(45) Date of Patent: Mar. 28, 2006

(54) RESISTORED ANODE AND A WATER HEATER INCLUDING THE SAME

(75) Inventor: Mark Allan Murphy, Nashville, TN (US)

(73) Assignee: Apcom, Inc., Franklin, TN (US)

( * ) Notice: Subject to any disclaimer, the term of this patent is extended or adjusted under 35 U.S.C. 154(b) by 0 days.

(21) Appl. No.: 11/001,232

(22) Filed: Dec. 1, 2004

(51) Int. Cl.
*B23P 25/00* (2006.01)

(52) U.S. Cl. ..... 29/458; 29/509; 204/280; 204/297.01; 204/196.17; 204/196.3; 204/196.23; 204/196.24; 204/196.25

(58) Field of Classification Search ..... 29/458, 29/509, 522; 204/280, 297.01, 196.17, 196.23–196.25, 204/196.3; 392/501, 503, 455
See application file for complete search history.

(56) References Cited

U.S. PATENT DOCUMENTS

| | | | | |
|---|---|---|---|---|
| 2,486,871 A | | 11/1949 | Osterheld | |
| 2,568,594 A | | 9/1951 | Robinson | |
| 2,740,757 A | | 4/1956 | Craver | |
| 3,542,663 A | | 11/1970 | Alewitz | |
| 3,891,530 A | * | 6/1975 | Alewitz | 204/196.16 |
| 4,035,903 A | * | 7/1977 | Taggart | 29/458 |
| 4,093,529 A | | 6/1978 | Strobach | |
| 4,543,469 A | | 9/1985 | Cunningham | |
| 4,786,383 A | | 11/1988 | Houle | |
| 5,109,474 A | | 4/1992 | Cameron | |
| 5,256,267 A | | 10/1993 | Roden | |
| 5,334,299 A | | 8/1994 | Roden | |
| 6,129,121 A | | 10/2000 | Kohle | |
| 2003/0202786 A1 | | 10/2003 | Pierre | |

* cited by examiner

*Primary Examiner*—Bruce F. Bell
(74) *Attorney, Agent, or Firm*—Michael Best & Friedrich LLP

(57) ABSTRACT

Apparatus and method of incorporating a resistive interface between an anode rod and a water heater tank connector. The resistive interface can include a conductive polymer material or coating.

22 Claims, 4 Drawing Sheets

RESISTORED ANODE AND A WATER HEATER INCLUDING THE SAME

BACKGROUND

Corrosion is an electrochemical process involving an anode (a piece of metal that readily gives up electrons), an electrolyte (a liquid that helps electrons move) and a cathode (a piece of metal that readily accepts electrons). When a piece of metal corrodes, the electrolyte helps provide oxygen to the anode. As oxygen combines with the metal, electrons are liberated. When the electrons flow through the electrolyte to the cathode, the metal of the anode disappears, swept away by the electrical flow or converted into metal cations in a form such as rust.

A cathodic protection system is implemented in water heaters to prevent corrosion of the water heater tank. The cathodic protection system includes an anode rod, which is electrically connected to the metal water heater tank. The anode rod is comprised of a metal, such as aluminum, magnesium, zinc, or alloys, that is more active than the metal tank of the water heater. The water heater tank is generally comprised of glass coated steel.

When water is introduced into the water heater tank, a galvanic circuit is created between the metal tank (and/or connectors) and the anode rod. As a result, electrical current flows from the anode, through the water, to the cathode, thus, the anode rod begins to corrode. If the water supply has a high mineral content, the current flow will increase, resulting in a corresponding increase in the consumption of the anode rod.

The addition of a resistor in the galvanic circuit can reduce the consumption time of the anode. Current resistored anodes have utilized electronic component type resistors that are costly, relatively difficult to assemble, and the assembly is fragile. A fragile resistor connection can result in a loss of ground connection that disables the anode and results in accelerated corrosion failure of the water heater tank.

Occasionally, certain natural waters that are heated in the presence of a magnesium or aluminum anode can generate smelly water with a sulphur aroma that is undesirable. The addition of a resistor in the galvanic circuit can reduce the anodic current to address the smelly water issue while not detrimentally impeding the necessary current flow that is important for proper water heater tank passivation protection.

SUMMARY

One embodiment of the invention includes a connector assembly comprising a metal conduit adapted to receive an anode rod and an interface comprising a conductive polymer layer on at least a portion of the metal conduit.

In another embodiment, the invention includes a connector assembly comprising a first cap in electrical communication with an anode rod and a conductive polymer layer on at least a portion of the first cap.

In yet another embodiment, the invention includes a connector assembly comprising a first cap in electrical communication with an anode rod and a second cap including a conductive polymer layer, the second cap adapted to receive the first cap.

In another embodiment, the invention includes a method of providing a resistive interface between an anode rod and a water heater tank. The method includes the acts of applying a layer of a conductive polymer to at least a portion of a metal conduit, connecting the metal conduit to the anode rod, connecting a nipple to the metal conduit, and securing the nipple to the water heater tank.

In yet another embodiment, the invention includes a water heater comprising a tank, an inlet to add water to the tank, an outlet that withdraws water from the tank, a heat source to heat water in the tank, a connector assembly electrically coupled to and supported by the tank, the connector assembly comprising a metal conduit adapted to receive an anode rod, and a conductive polymer layer on at least a portion of the metal conduit, and an anode rod electrically coupled to and supported by the connector assembly.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected," "supported," and "coupled" are used broadly and encompass both direct and indirect mounting, connecting, supporting, and coupling. Further, "connected" and "coupled" are not restricted to physical or mechanical connections or couplings, and can include electrical connections or couplings, whether direct or indirect.

Figure 1:
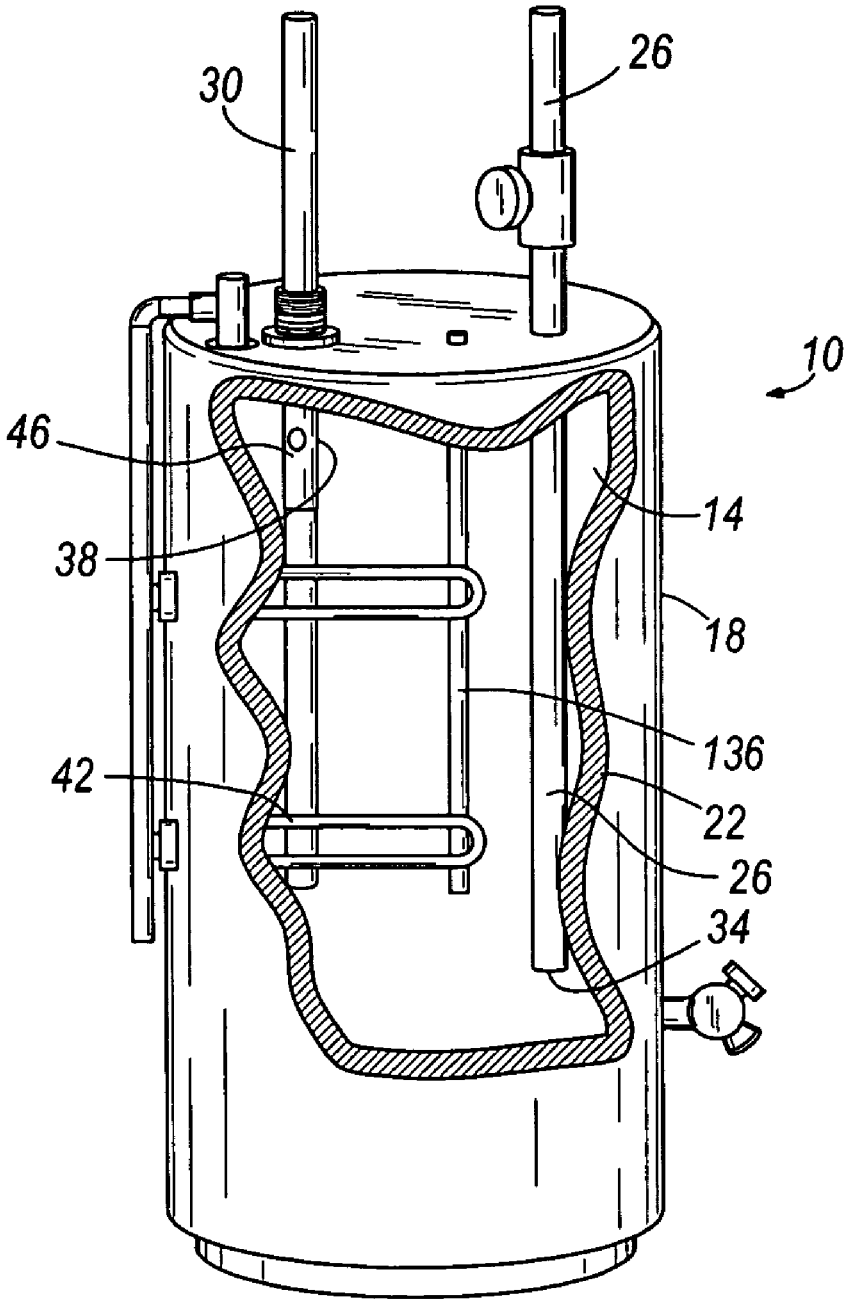
FIG. 1 is a partial broken-away perspective view of a water heater.

FIG. 1 illustrates a water heater 10 including a permanently enclosed water tank 14, a shell 18 surrounding the water tank 14, and foam insulation 22 filling the annular space between the water tank 14 and the shell 18. A water inlet line or dip tube 26 and a water outlet line 30 enter the top of the water tank 14. The water inlet line 26 has an inlet opening 34 for adding cold water near the bottom of the water tank 14. The water outlet line 30 has an outlet opening 38 for withdrawing hot water from near the top of the water tank 14. The water heater 10 also includes a resistance heating element 42 that extends through a wall of the water tank 14 and an anode rod 46, 136. While an electric water heater is shown, the invention can be used with other water heater types, such as a gas water heater, and with other water heater designs.

Figure 2:
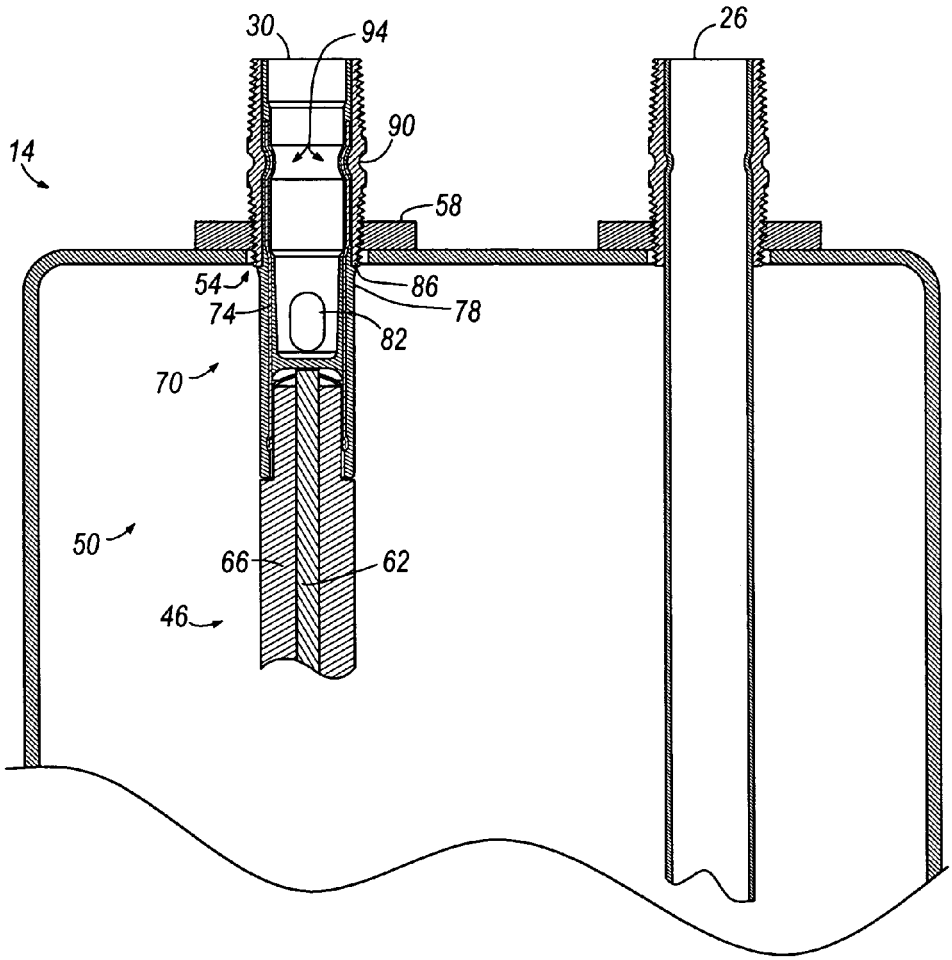
FIG. 2 is a cross-sectional view of a portion of another construction of a water heater tank.

FIG. 2 illustrates a portion of an enlarged cross-sectional view of the water tank 14, the water inlet line 26, and the water outlet line 30. The water outlet line 30 includes an anode rod assembly 50 according to one embodiment of the invention. The water tank 14 includes an opening 54 through which the anode rod assembly 50 is positioned. The water tank 14 includes a spud 58 secured to the top of the water tank 14 and is aligned with the opening 54. The spud 58 is internally threaded and generally comprised of steel.

The anode rod assembly 50 includes an anode rod 46 comprised of a rod or metal wire 62 surrounded by metal 66, which is more active than the metal that is used to make the water tank 14. For example, the metal 66 on the anode rod 46 can be aluminum, magnesium, zinc, or an alloy. The anode rod 46 is electrically connected to the water tank 14 with a connector assembly 70. The anode rod 46 is welded or secured in any other manner to the connector assembly 70.

Figure 4:
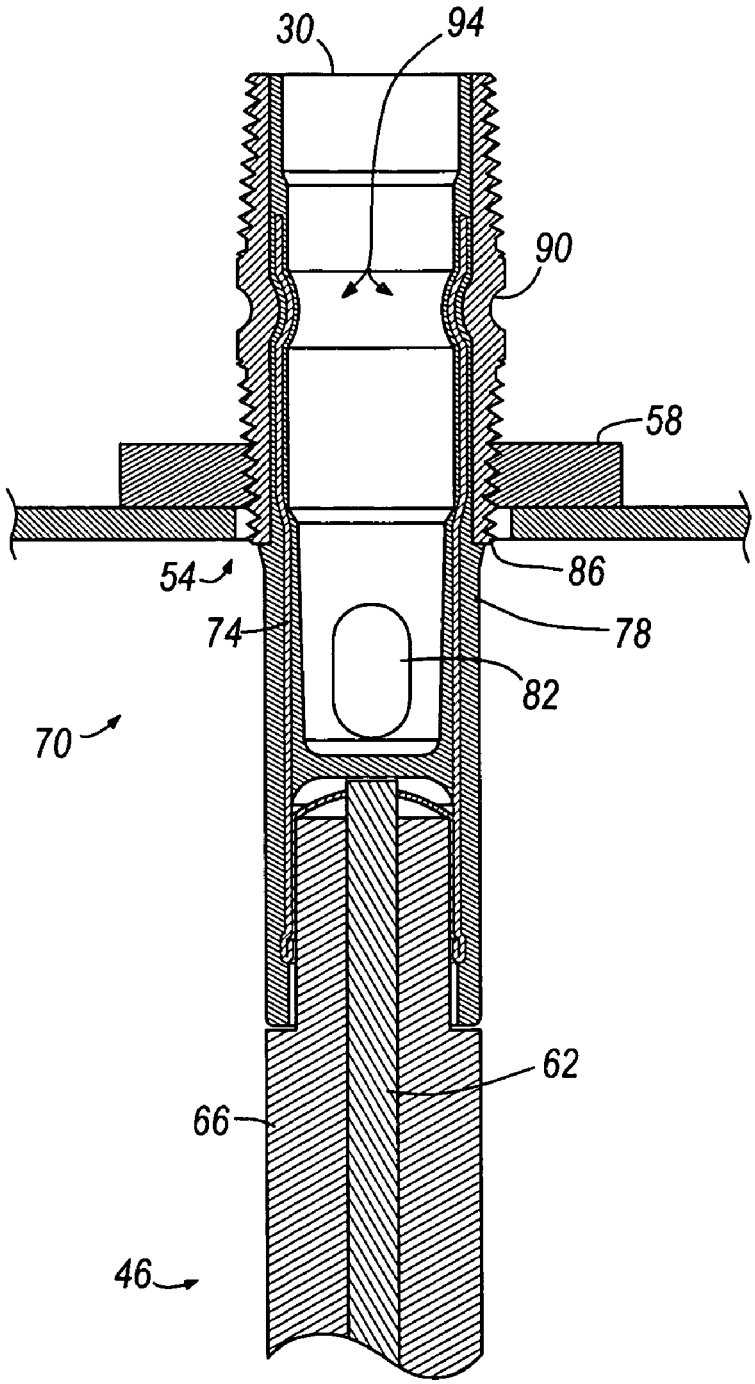
FIG. 4 is an enlarged cross-sectional view of a connector assembly of FIG. 2.

As illustrated in FIGS. 2 and 4, the connector assembly 70 includes a metal conduit 74 that is surrounded or overmolded with a conductive polymer material or a conductive coating 78. The conductive polymer material or conductive coating 78 can be filled with carbon, for example, and/or any other conductive material and/or components. The metal conduit 74 can include the conductive polymer material or conductive coating 78 on the inner portion, outer portion, top portion, and/or bottom portion of the metal conduit 74. The connector assembly 78 includes an opening 82 through which hot water from the water tank 14 can flow to the water outlet line 30 and to a destination. The opening 82 is generally located above the anode rod 46.

The connector assembly 70 further includes a nipple 86 that is received in the spud 58 to secure the anode rod assembly 50 in the water tank 14. The nipple 86 is positioned on or around the conductive polymer material or conductive coating 78. The nipple 86 includes a circumferential groove 90 to receive a lock ring, which secures the connector assembly 70 to the anode rod 46 and generates a galvanic circuit between the anode rod assembly 50 and the water tank 14.

The conductive polymer material 78 provides a resistance to ground potential in the galvanic circuit between the anode rod 46 and the water tank 14. The resistance can be in the range of about 5 ohms to about 500 ohms. The resistance also can be in the range of about 30 ohms to about 60 ohms.

In one construction, the conductive polymer material or conductive coating 78 can be applied only to an area 94 on the metal conduit 74 where the nipple 86 contacts the metal conduit 74 (e.g., a sleeve on the area 94 on the metal conduit 74 where the lock ring is applied on the nipple 86). In this construction, the conductive polymer material 78 provides a resistance to ground in the galvanic circuit between the anode rod 46 and the water tank 14. The resistance can be in the range of about 5 ohms to about 500 ohms. The resistance also can be in the range of about 30 ohms to about 60 ohms.

Figure 3:
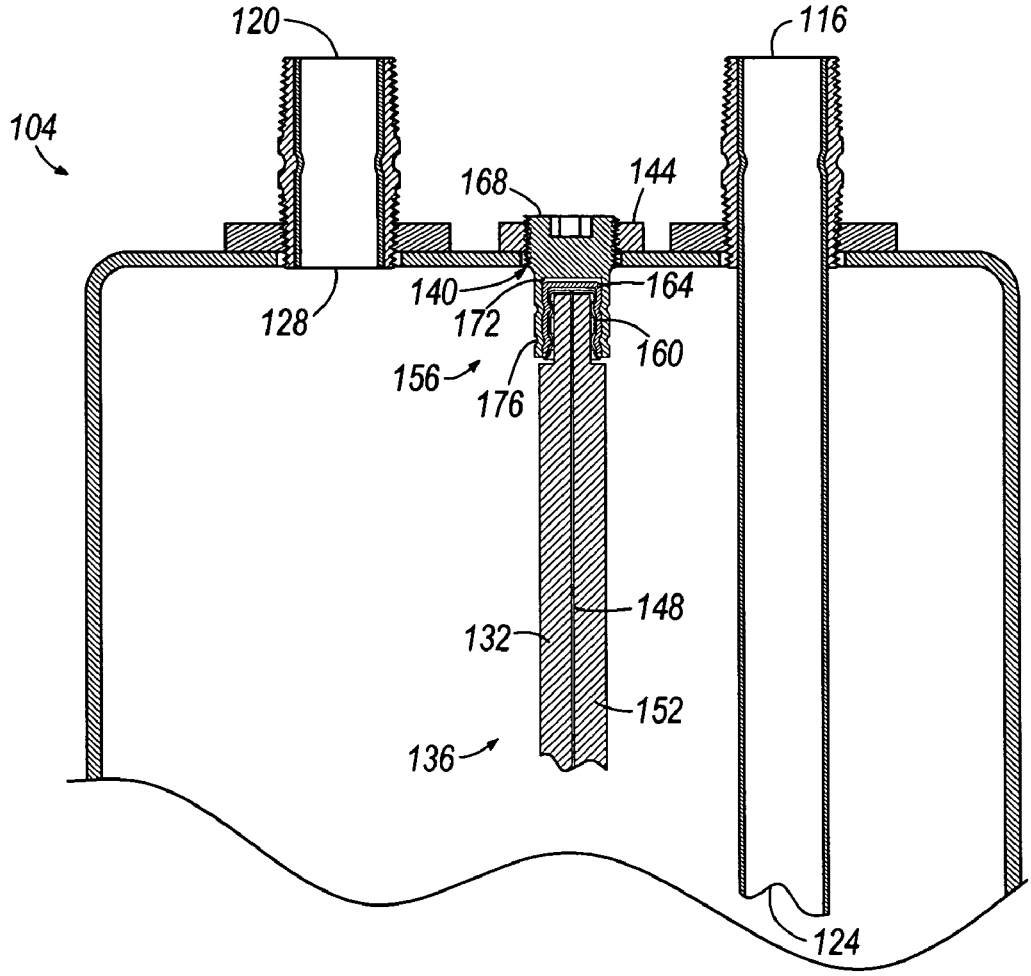
FIG. 3 is a cross-sectional view of a portion of another construction of a water heater tank.

FIG. 3 illustrates a portion of an enlarged cross-sectional view of a water tank 104. A water inlet line or dip tube 116 and a water outlet line 120 enter the top of the water tank 104. The water inlet line 116 has an inlet opening 124 for adding cold water near the bottom of the water tank 104. The water outlet line 120 has an outlet opening 128 for withdrawing hot water from near the top of the water tank 104. The water tank 104 also includes a resistance heating element that extends through a wall of the water tank 104 and an anode rod 132.

The water tank 104 includes an anode rod assembly 136. The anode rod assembly 136 can be utilized at a location on the water tank 104 other than the water outlet line 120 of the water tank 104. The water tank 104 includes an opening 140 through which the anode rod assembly 136 is positioned. The water tank 104 includes a spud 144 secured to the top of the water tank 104 and is aligned with the opening 140. The spud 144 is internally threaded and generally comprised of steel.

The anode rod assembly 136 includes the anode rod 132 comprised of a metal wire 148 surrounded by metal 152 that is more active than the metal that is used to make the water tank 104. For example, the metal 152 on the anode rod 132 can be aluminum, magnesium, zinc, or alloys. The anode rod 132 is electrically connected to the water tank 104 with a connector assembly 156. The connector assembly 156 includes a stainless steel cap 160 that is electrically connected to the metal wire 148. The connector assembly 156 includes a conductive polymer material or conductive coating 164, (referred to hereinafter as the conductive cap 164) that is applied to, supported by, and/or secured to the stainless steel cap 160.

The connector assembly 156 includes a metallic fitting 168 (e.g., ¾" NPT fitting) that is received in the spud 144 to secure the anode rod assembly 136 in the water tank 104. The fitting 168 includes a counterbore 172 that can receive the anode rod 132 (including the stainless steel cap 160 and the conductive cap 164 or a conductive coating applied to the stainless steel cap 160). The conductive cap 164 or conductive coating on the stainless steel cap 160 can interface with the fitting 168 and or the counterbore 172. The fitting 168 has a mechanical groove 176 applied to the external diameter during the assembly process, which secures the connector assembly 156 to the anode rod 132.

The connector assemblies 70 and 156 are more robust than a conductive all plastic threaded connector assembly that secures the anode rod in the water heater tank. A plastic connector is expensive to mold and is more prone to breakage than a metal connector.

Various features and advantages of the invention are set forth in the following claims.

What is claimed is:

1. A connector assembly comprising:

a metal conduit adapted to receive an anode rod, the metal conduit having an interior surface and an exterior surface;

a nipple adapted to support the metal conduit, the nipple including a first end and a second end, a portion of the metal conduit positioned between the first end and the second end of the nipple; and an interface comprising a conductive polymer layer on at least a portion of the interior surface of the metal conduit positioned between the first end and the second end of the nipple.

2. The connector assembly of claim 1 wherein the nipple is in electrical communication with the metal conduit at the interface.

3. The connector assembly of claim 1 wherein the metal conduit and the anode rod are in electrical communication.

4. The connector assembly of claim 1 wherein the conductive polymer layer includes carbon.

5. A connector assembly comprising:

a cap in electrical communication with an anode rod;

a fitting in direct electrical communication with the cap, the fitting adapted to be connected to a water tank; and a conductive polymer layer between the fitting and the cap.

6. The connector assembly of claim 1 wherein the conductive polymer layer is on at least a portion of the exterior surface of the metal conduit positioned between the first end and the second end of the nipple.

7. The connector assembly of claim 5 wherein the anode rod and the fitting are in electrical communication.

8. A connector assembly comprising:

a first cap in electrical communication with an anode rod; and a second cap including a conductive polymer layer, the second cap adapted to receive the first cap.

9. The connector assembly of claim 8 and further comprising a fitting adapted to receive the second cap, the fitting in electrical communication with the second cap.

10. The connector assembly of claim 9 wherein the anode rod and the fitting are in electrical communication.

11. A method of providing a resistive interface between an anode rod and a water heater tank, the method comprising:

applying a layer of a conductive polymer to a portion of an interior surface and an exterior surface of a metal conduit, a portion of the metal conduit positioned between a first end and a second end of a nipple, the portion of the interior surface of the metal conduit receiving the layer of the conductive polymer being positioned between the first end and the second end of the nipple;

connecting the metal conduit to the anode rod;

connecting the nipple to the metal conduit, the nipple in contact with the conductive polymer layer; and securing the nipple to the water heater tank.

12. The method of claim 11 wherein the conductive polymer layer provides a resistance in the range of about 5 ohms to about 500 ohms between the anode rod and the water heater tank.

13. The method of claim 11 wherein the conductive polymer layer provides a resistance in the range of about 30 ohms to about 60 ohms between the anode rod and the water heater tank.

14. The method of claim 11 wherein a portion of the exterior surface of the metal conduit that receives the layer of the conductive polymer is positioned between the first end and the second end of the nipple.

15. A water heater comprising:

a tank;

an inlet to add water to the tank;

an outlet that withdraws water from the tank;

a heat source to heat water in the tank;

an anode rod electrically coupled to the tank; and a connector assembly electrically coupled to and supported by the tank, the connector assembly comprising a metal conduit adapted to receive the anode rod, the metal conduit having an interior surface and an exterior surface, a nipple adapted to support the metal conduit, the nipple including a first end and a second end, a portion of the metal conduit positioned within the first end and the second end of the nipple, and a conductive polymer layer on at least a portion of the interior surface of the metal conduit positioned between the first end and the second end of the nipple.

16. The water heater of claim 15 wherein the nipple of the connector assembly is in electrical communication with the metal conduit.

17. The water heater of claim 15 wherein the metal conduit and the anode rod are in electrical communication.

18. The water heater of claim 15 wherein the conductive polymer layer includes carbon.

19. The water heater of claim 15 wherein a portion of the exterior surface of the metal conduit that receives the layer of the conductive polymer is positioned between the first end and the second end of the nipple.

20. A water heater comprising:

a tank;

an inlet to add water to the tank;

an outlet that withdraws water from the tank;

a heat source to heat water in the tank;

an anode rod electrically coupled to the tank; and a connector assembly electrically coupled to and supported by the tank, the connector assembly comprising a first cap in electrical communication with the anode rod, and a second cap including a conductive polymer layer, the second cap adapted to receive the first cap.

21. The water heater of claim 20 wherein the connector assembly further comprises a fitting adapted to receive the second cap, the fitting in electrical communication with the second cap.

22. The water heater of claim 21 wherein the anode rod and the fitting are in electrical communication.

* * * * *